United States Patent [19]

Varga

[11] 4,115,971

[45] Sep. 26, 1978

[54] SAWTOOTH COMPOSITE GIRDER

[76] Inventor: I. Steven Varga, 398 Woodward St., Waban, Mass. 02168

[21] Appl. No.: 824,049

[22] Filed: Aug. 12, 1977

[51] Int. Cl.[2] ..... E04B 1/24

[52] U.S. Cl. ..... 52/334; 52/250; 52/252; 52/667; 52/723; 52/733

[58] Field of Search ..... 52/223 R, 333, 334, 52/250–252, 667, 634, 636, 733, 723

[56] References Cited

U.S. PATENT DOCUMENTS

| | | | |
|---|---|---|---|
| 1,883,376 | 10/1932 | Hilpert et al. | 52/690 X |
| 1,982,343 | 11/1934 | Kane | 52/252 |
| 2,636,377 | 4/1953 | Hilpert | 52/334 |
| 3,260,024 | 7/1966 | Greulich | 52/223 R |
| 3,336,718 | 8/1967 | Cape | 52/692 X |
| 3,596,421 | 8/1971 | Miller | 52/333 |
| 3,761,046 | 9/1973 | Jessop | 52/667 X |

FOREIGN PATENT DOCUMENTS

| | | | |
|---|---|---|---|
| 271,848 | 3/1914 | Fed. Rep. of Germany | 52/634 |
| 2,218,573 | 10/1973 | Fed. Rep. of Germany | 52/733 |
| 937,440 | 9/1963 | United Kingdom | 52/334 |
| 487,467 | 6/1938 | United Kingdom | 52/634 |

*Primary Examiner*—Alfred C. Perham
*Attorney, Agent, or Firm*—Richard L. Stevens

[57] ABSTRACT

A composite beam or girder fabricated from a section of an "I" shaped rolled structural steel beam and a reinforced concrete slab is formed. The bottom flange and the web of the girder are a section of the "I" beam, the top "top flange" is the concrete slab. The steel section is obtained by cutting the web of the "I" beam in a zig-zag fashion into two similar sections, each having a flange and a sawtooth shaped web. Effective interconnection of the steel section and the reinforced concrete slab is achieved by anchor rods snugly fit into holes provided in the top part of the web.

14 Claims, 6 Drawing Figures

SAWTOOTH COMPOSITE GIRDER

BACKGROUND OF THE INVENTION

The construction cost of floors and roofs is directly affected by the amount of material used and the depth of floor (roof) construction. Depth of floor construction is referred to as the zone enclosed by the floor surface on the top and the ceiling at the bottom. This zone contains the girders, beams and slabs required for the structure; and the air conditioning ducts, plumbing and lighting elements, etc., required for the mechanical sub-systems. The greater this depth is, the taller the building must be for the same height of useful living space. In order to achieve savings in the weight of steel beams and the depth of floor construction, "composite construction" has been increasingly utilized.

Several composite construction systems are available. The basic and most commonly used composite construction, combines a reinforced concrete slab and an "I" shaped steel beam in a single load carrying component, in which the concrete slab resists the compression and the steel beam the tension component produced by the bending moment. In this mode of construction, shear connectors are welded to the top flange of the steel beam. These connectors, when embedded in the concrete slab, ensure that the two materials work in unison. Shear connectors may be of several types. See U.S. Pat. No. 2,987,855 and U.S. Pat. No. 3,210,900. Because the thickness of the concrete slab is usually controlled by considerations other than the compression due to composite action, there is a large excess capacity available for the resistance of these forces. The design of the steel beam is governed by the tension in the bottom flange. As a consequence, when a rolled "I" beam is used for composite construction, because its top and bottom flanges are identical, its top flange is not fully utilized. This lack of full effectiveness of the top flange in composite construction was reported on by A. A. Toprac in *AISC Engineering Journal,* "Strength of Three New Types of Composite Beams", January 1965.

SUMMARY OF THE INVENTION

This invention provides a composite longitudinal support structure such as a girder or beam whose bottom flange and web are of steel or a similar material and whose top flange is a concrete slab or similar material. The invention also provides a structure and method for achieving interaction (composite behavior) of the steel and concrete components.

The invention in one embodiment comprises a first section having a flange and a web; the outer edge of the web having a plurality of projections extending therefrom and defining recesses therebetween. The projections may assume any geometric configuration, such as saw-toothed, notched, nicked, crenated, detented, palmated, serrated, scalloped, escalloped or any combination thereof. The projections may be uniform or nonuniform.

Anchor elements are attached to the projections by welding, threading, bolting or any other procedure and include and device which thus can be secured to the projections such as the shear studs commonly used in composite construction, bolts, angle irons, etc.

The anchor elements which are secured to the projections of the first sections are preferably rod-like members extending through the projection and may be round, square, rectangular, eliptical, etc. in cross-section. In the preferred embodiment the rods are transverse to the plane of the projection and extend outwardly an equal distance from both sides of the projection.

A second slab-like section is cast on the projection and over the anchor elements. When the second section is set a composite structure is formed; the second section with the projections defining an aperture.

In the preferred embodiment of the invention the web of a rolled structured steel "I" beam is cut in a zig-zag fashion into two similar first sections, each having a flange and projections in the form of a sawtooth shaped web. This first section, when oriented in a manner that the flange is at the bottom, can be equipped at the top part of the sawteeth with anchor rods. A second section such as a concrete slab is cast such that the top parts of the sawteeth together with the anchor rods become embedded in the concrete, the two sections interlock producing a new load carrying element.

The division of the "I" beam into two first sections may be achieved by flame cutting, shearing, punching or other methods. The positive interconnection between the first and second sections is accomplished by punching or drilling the required number and size of holes in the top region of the "teeth". When the first section is secured into its final position in the building structure and the forms of the concrete slab are placed, usually a couple of inches below these holes, short horizontal anchor rods can snugly be fit through these holes protruding a few inches symmetrically on both sides of the web. When casting the floor slab, the anchor rods become embedded in the concrete forming a positive interlocking mechanism: the section of the web engaged by the concrete prevents relative horizontal movement perpendicular to the plane of the web, while the anchor rods inhibit relative horizontal movement parallel to the longitudinal axis of the member and relative vertical displacement.

When it is desirable that the depth of the sawtooth shaped steel section be increased beyond the height limited by the availability of rolled I beams, extension plates of proper strength and proportion may be welded to the top of the "teeth".

DESCRIPTION OF THE PREFERRED EMBODIMENT

The floor slabs of commonly encountered structures such as buildings, parking facilities, bridges, etc. are frequently constructed of cast-in-place concrete formed on either permanent or temporary surfaces. Corrugated metal decks are typical permanent surfaces while plywood and fiberglass are typical temporary surfaces. The slabs are designed to span between supporting beams. If the supporting beam system is steel, composite construction as defined by the American Iron and Steel Institute becomes feasible: "composite construction shall consist of steel beams or girders supporting a reinforced concrete slab, so interconnected that the beam and slab act together to resist bending". Efficiency of the system is attributed to the utilization of the readily available compression capacity of the concrete slab that assists the steel beam in resisting the bending moments and thus leads to a reduction of both the quantity of steel and the depth of beam.

The present invention takes maximum advantage of this capacity by entirely eliminating the top steel flange and resisting the compression by the concrete slab alone.

Figure 1:
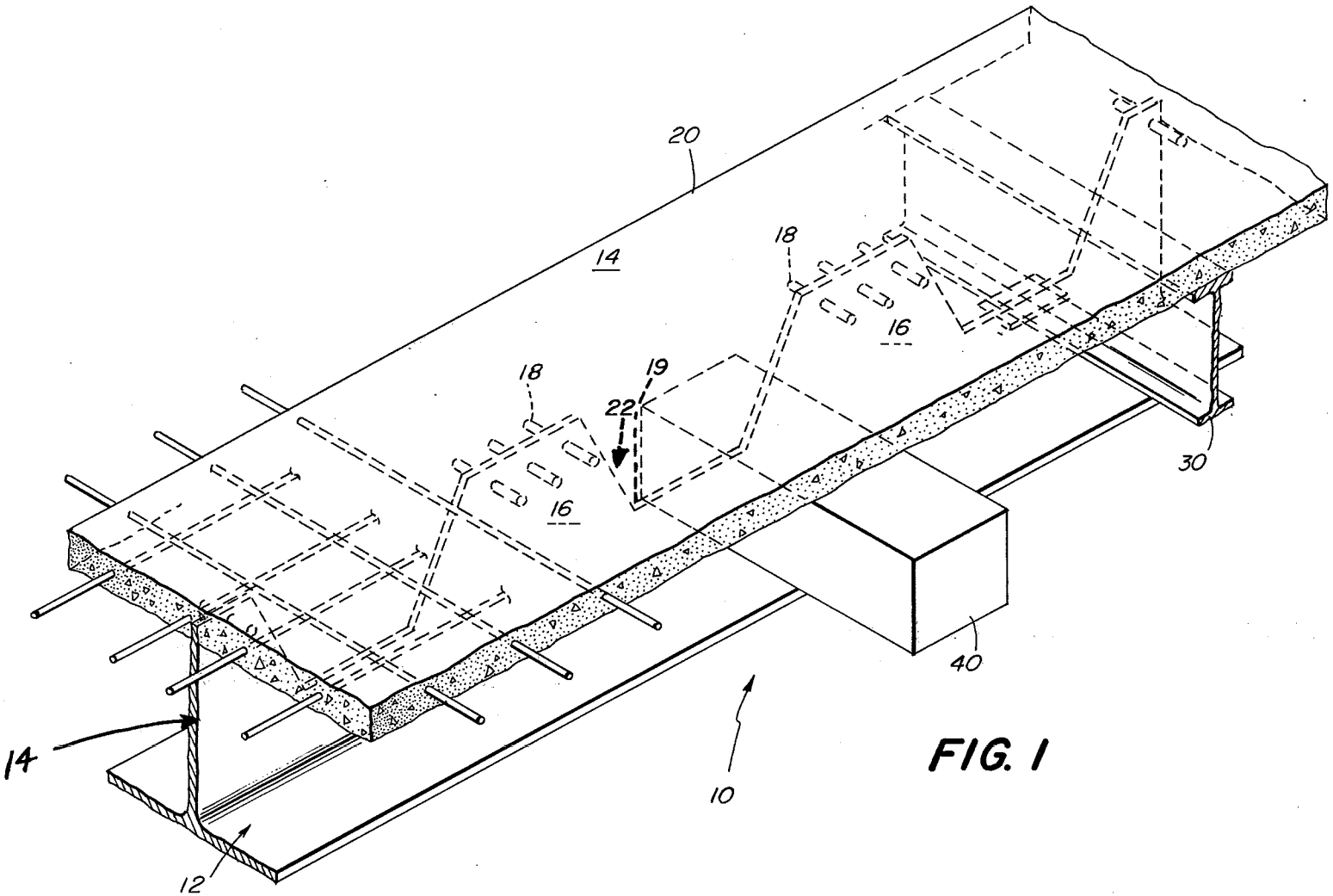
FIG. 1 is a fragmentary diagrammatic isometric view of a sawtooth composite girder with beam and duct through apertures.
Figure 6:
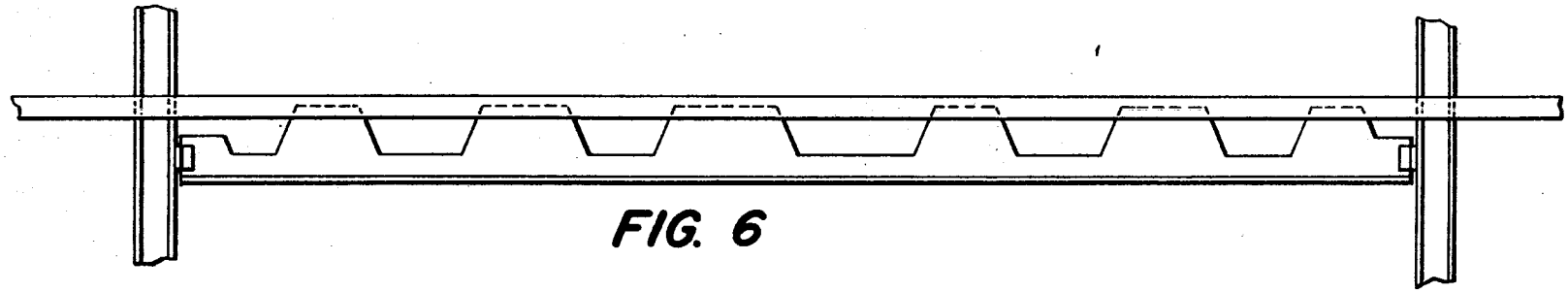
FIG. 6 is a front elevation of a variable profile.

The preferred embodiment of the invention is shown in FIG. 1 at 10 and comprises a first section 12 of a rolled structural steel "I" beam whose web 14 has been cut to form uniform truncated sawtooth projections 16. The cut is designed to optimize the use of steel and to provide maximum apertures. This optimization may lead to a variable profile (non-uniformly spaced and/or shaped projections), that is dependent on the variation of internal forces along the span. One such embodiment is shown in FIG. 6. The internal forces are determined for all loading conditions including, transportation and erection of steel section, support of wet concrete by steel section shored at regular intervals, and dead and live loads on composite girder.

Holes are pre-punched or pre-drilled to receive anchor rods 18. The second section comprises a reinforced concrete slab 20. When the reinforced concrete slab 20 is cast, it surrounds the anchor rods 18 and the top part of the projections 16, thus producing composite action.

Prior to casting the slab 20 one or more beams 30 may be received between one or more sets of opposed projections 16. When the concrete slab 30 has set, apertures 22 are defined by the lower surface of the slab 20, the projections 16 and the surface 19. Mechanical ducts 40 are received in the apertures 22 and supported by the first section 12. Thus both the beams 30 and the ducts 40 pass through the apertures 22.

Figure 2:
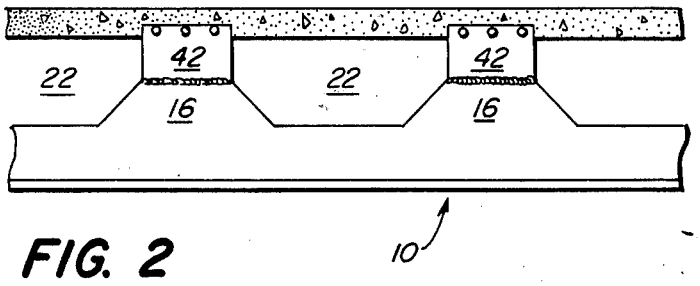
FIG. 2 is a fragmentary diagrammatic side elevation of a composite girder with extension plates.

Large spans, heavy loads or the need for large apertures may demand that the depth of the sawtooth shaped steel section be increased beyond the height limited by the availability of rolled "I" shaped members. To achieve the desired profile, extension plates of the proper strength and proportion may be welded to the top of the projections 16. Referring to FIG. 2 extension plates 42 are shown welded to the projections 16.

Figure 3:
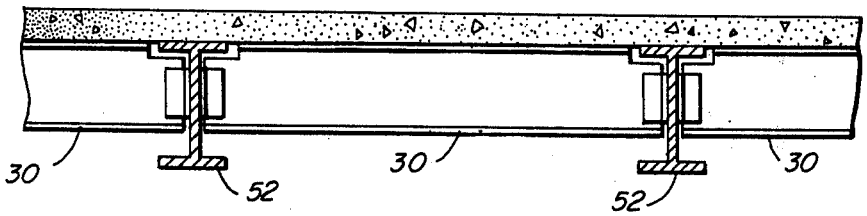
FIG. 3 (PRIOR ART)
FIG. 3 is a fragmentary diagrammatic section of girder-beam relation in common steel construction.

While the reductions in the weight and depth of the above composite structural member in reference to prior art members is important, my invention results in further efficiencies for the rest of the floor structure. When my invention is used to support beams, an estimated 20% beam weight reduction can be achieved compared to common construction practice. According to common practice beams are simply supported between girders, which girders' continuous webs define natural planes of termination for the beams. In FIG. 3 beams 50 are supported by the girders 52. This mode of support results in zero bending moment in the beam at its supports (at the girders) and maximum bending at midspan. Since rolled sections have constant cross-sections and the beam is sized according to the moment at midspan, it is decreasingly utilized toward the supports.

The apertures 22 of the composite construction of my invention provide both for support of the beams and extension beyond the planes of the girders.

Figure 4:
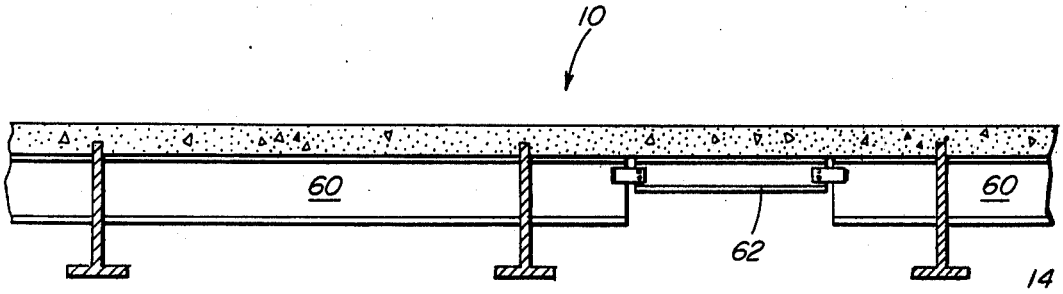
FIG. 4 is a fragmentary diagrammatic section of girder-beam relation embodying the present invention.

FIG. 4 shows such an extended beam. More particularly a support structure of the present invention 10 functions as a girder and primary beams 60 pass through the apertures 22 (not shown). This extension of the beams allows a balanced design whereby the controlling midspan beam moments and consequently the beam sizes can be reduced. Between the primary beams 60 that extend beyond the girder, shorder and lighter secondary beams 62 are supported using standard connections.

Further advantages of the girder apertures are derived by threading the mechanical sub-systems: ducts, pipes and electrical conduits through these openings. This integration of the structural and mechanical zones reduces the depth of floor construction, and consequently the building height.

Figure 5:
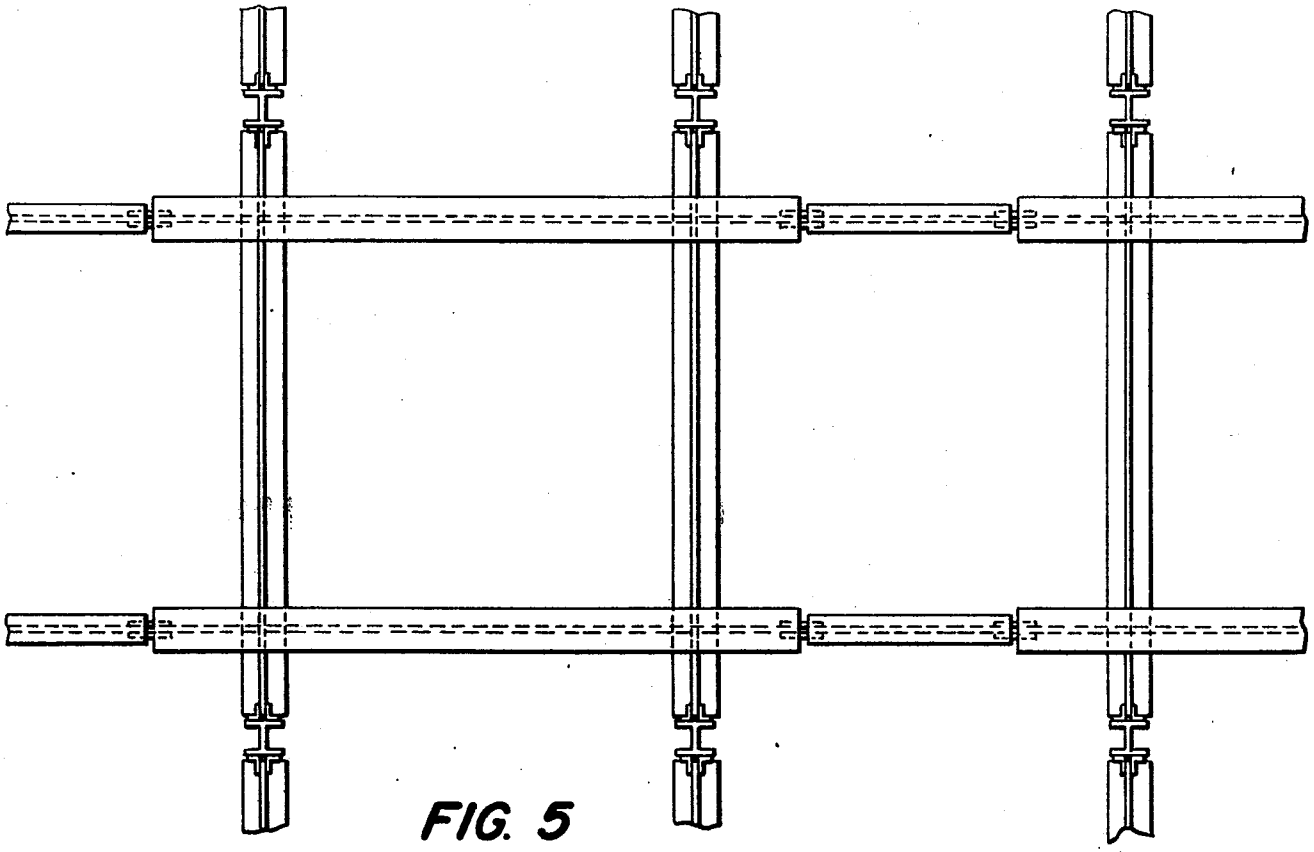
FIG. 5 is a plan view of the concept of FIG. 4 in a structural assembly (concrete slab not shown).

A typical structural assembly as shown in FIG. 4 and 5, would comprise a plurality of composite beams functioning as girders, the girders arranged in spaced apart parallel relationship and secured in a conventional manner. They may also be arranged in nonparallel relationship. The specific manner in which the composite girders are secured to columns or other supporting elements, including temporary shores, temporary or permanent form work as required and the actual method used for casting the concrete, whether reinforced or not, is well known in the art and need not be described in detail.

Having described my invention what I now claim is:

1. A composite structural member comprising:

a first section having a lower flange portion and a web, the web having a plurality of projections extending therefrom, the projections defining recesses therebetween and forming a discontinuous web, at least one anchor member secured to at least one side of the upper portion of each projection, a second section comprising a cast concrete floor slab, said floor slab secured to the upper portion of each projection, the anchor member being engaged therewith, the floor slab defining with the projections, apertures adapted for the passage of longitudinal members therethrough said slab further comprising the sole compression part of the member and resisting substantially the entire compressive force acting on the member, and being the sole connector for the series of projections.

2. The member of claim 1 wherein the projections are uniformly formed and spaced.

3. The member of claim 2 wherein the projections are formed as truncated sawtoothed projections.

4. The member of claim 1 wherein the projections are non-uniformly formed and spaced.

5. The member of claim 4 wherein the projections are formed as truncated sawtoothed projections.

6. The member of claim 4 wherein the anchor member comprises a plurality of anchor rods extending through the upper portion of the projection.

7. The member of claim 6 wherein the concrete slab is a reinforced concrete slab.

8. A structural assembly which comprises:

a composite girder having a first section with a lower flange portion and a web, the web having a plurality of projections extending therefrom, the projections defining recesses therebetween and forming a discontinuous web, at least one anchor member secured to at least one side of the upper portion of each projection, a second section comprising a cast concrete floor slab, said floor slab secured to the upper portion of each projection, the anchor member being engaged therewith, the floor slab defining with the projection apertures adapted for the passage of structural members therethrough said slab further comprising the sole compression part of the member and resisting substantially the entire compressive force acting on the member, and being the sole connector for the series of projections; and at least one beam extending through one of said apertures, and being supported by said girder.

9. The structural assembly of claim 8 which includes a plurality of composite girders arranged in spaced apart relationship.

10. The structural assembly of claim 8 which includes a plurality of composite girders arranged in spaced apart relationship, and a plurality of beams passing through the apertures of the girders and the beams being supported by said girders.

11. The assembly of claim 9 wherein the beam comprises primary and secondary beams and the secondary beam is of reduced cross-sectional area in reference to the primary beam which primary beam passes through the apertures of the girder.

12. The assembly of claim 11 wherein the projections are uniformly spaced, truncated sawtoothed projections and the anchor member includes a plurality of anchor rods passing through the upper portion of the sawtoothed projections.

13. The members of claim 11 wherein the projections are non-uniformly formed and spaced.

14. The assembly of claim 9 wherein the composite girders are arranged in spaced apart parallel relationship.

* * * * *

UNITED STATES PATENT AND TRADEMARK OFFICE

CERTIFICATE OF CORRECTION

PATENT NO. : 4,115,971

DATED : September 26, 1978

INVENTOR(S) : I. Steven Varga

It is certified that error appears in the above-identified patent and that said Letters Patent are hereby corrected as shown below:

Abstract, line 5 "top" (first occurrence) should be deleted.

Column 1, line 62

"and" should be -- any --

Column 3, line 36

"30" should be -- 20 --

Column 4, line 8

"shorder" should be -- shorter --

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*